United States Patent [19]

Möeller et al.

[11] 4,080,584

[45] Mar. 21, 1978

[54] APPARATUS FOR ELECTROMAGNETIC RELAY

[75] Inventors: Helmut Möeller, Munich; Georg Aigner, Ebersberg, both of Germany

[73] Assignee: Siemens Aktiengesellschaft, Berlin & Munich, Germany

[21] Appl. No.: 751,674

[22] Filed: Dec. 17, 1976

[30] Foreign Application Priority Data

Dec. 18, 1975 Germany ..... 2557127

[51] Int. Cl.[2] ..... H01H 45/00

[52] U.S. Cl. ..... 335/135; 200/247; 335/202

[58] Field of Search ..... 335/135, 128, 133, 106, 335/127, 202; 200/237, 245, 246, 247

[56] References Cited

U.S. PATENT DOCUMENTS

| | | | |
|---|---|---|---|
| 3,056,007 | 9/1962 | Keenan | 335/135 |
| 3,242,285 | 3/1966 | Obszarny et al. | 335/135 |
| 3,636,483 | 1/1972 | Jambrink et al. | 335/135 |

*Primary Examiner*—Harold Broome

*Attorney, Agent, or Firm*—Hill, Gross, Simpson, Van Santen, Steadman, Chiara & Simpson

[57] ABSTRACT

A spring retaining clip for mounting a contact carrying insulator on the return pole piece of an electromagnetic relay. The spring retaining clip is generally U-shaped and has a resilient back wall member adapted to be disposed between the return pole piece of the relay and the excitation coil thereof. The spring retaining clip also includes a pair of side wall members which straddle a central portion of the return pole piece and which interlock with a corresponding pair of side wall members of the contact carrying insulator. In a free state condition, the back wall member is curved similarly to the curved outer surface of the excitation coil, but must be straightened somewhat and forced into engagement with the central portion of the return pole piece before the side wall members of the spring retaining clip and the insulator can become interlocked in assembled relation with one another.

9 Claims, 4 Drawing Figures

APPARATUS FOR ELECTROMAGNETIC RELAY

BACKGROUND OF THE INVENTION

This invention relates generally to the field of electromagnetic relays and more particularly to a spring retaining clip for mounting a contact carrying insulator on the return pole piece of an electromagnetic relay.

Mechanisms for mounting the contacts on an electromagnetic relay are known in the prior art. Such mechanisms, which may be referred to as fixing or fastening devices, have in some instances included generally U-shaped clip members (see, for example, German Utility Model No. 1,984,667 and German Published Specification No. 1,948,725), as does the present invention. Such previously known fixing devices have involved metal-to-metal contact between the clip members and the magnet systems of the relays. This metal-to-metal contact is disadvantageous when the earth potential is not run out of the relay and it is desired to obtain long creep paths inside the relay between the earth potential of the magnet yoke or return pole piece on the one hand and the coil connections or the contact springs on the other hand.

SUMMARY OF THE INVENTION

A principal object of the invention is to connect the magnet system of an electromagnetic relay with the contact spring set by means of a fixing or fastening device of the kind generally described hereinabove in a manner whereby ease of assembly is ensured and whereby the spring retaining clip is constructed and arranged so that adequately long creep paths are obtainable even for power current contacts while requiring a minimum amount of space.

The foregoing object is achieved in accordance with the principles of the present invention by providing the spring retaining clip with a back wall member which is disposed between the return pole piece and the excitation coil and which is curved at least partially in a manner corresponding to the curvature of the excitation coil winding, and by further providing the spring retaining clip with a pair of side wall members which straddle the return pole piece and which can be interlocked by means of suitable projections, recesses and the like with an insulator which carries the contact springs.

By virtue of the present invention the side wall members of the spring retaining clip are no longer in contact with a metal part, but instead with the plastic or other non-metal type of insulator which carries the contact spring set. In this manner the requisite insulation conditions are more easily achieved.

On the other hand, the material of which the insulator is made cannot withstand mechanical stresses to the same degree as a member made of iron, such as the return pole piece. As a consequence, the spring retaining clip must be constructed and arranged to have a fairly long spring travel, as contrasted with prior art spring retaining clips, to prevent exceeding the load capability of the plastic insulator.

In order to reduce the space requirement for the spring retaining clip, the present invention involves the disposition of the spring retaining clip within the coil chamber of the relay so that the back wall member of the clip is curved to correspond to the curvature of the coil windings and resides in the otherwised unused space to the permit lengthy spring travel.

The spring retaining clip and the insulator can be interlocked by means of cooperating interlocking members formed on the facing side wall members of the spring retaining clip and the insulator. Such interlocking members may comprise window-shaped recesses formed in the side wall members of the spring retaining clip and lugs or projections formed on the side wall members of the insulator.

On the other hand, flange or hook-shaped elements or members may also be formed on the retaining clips to engage corresponding locking recesses formed in the insulator. In this arrangement, and in order to obtain long creep paths, it is preferable for the insulator to wholly or partially engage the return pole piece by means of lateral extensions, such that the interlocking takes place in proximity to the return pole piece and so that the side wall members of the spring retaining clip are disposed as far as possible from the contact springs. Another advantage of the lateral extensions extending over the return pole piece resides in the fact that by virtue of this arrangement simple centering is achieved between the contact spring set and the magnet system. In order to provide such centering, suitable lugs or the like can be provided on the return pole piece.

In order to ensure that the fixing device of the present invention is easily mounted on the relay, it is advantageous to connect the spring retaining clip to the return pole piece in a preliminary assembly operation. Another advantage of such preliminary assembly operation is to ensure that the sensitive excitation coil winding is not damaged during assembly by the spring retaining clip, the two being situated in extremely close proximity.

In one embodiment of the invention, the back wall member of the spring retaining clip may be connected in fixed assembly to the return pole piece by means of riveting, spot welding or the like. In another form of the invention the side wall members of the spring retaining clip may be locked on lateral supporting lugs or teeth formed on the return pole piece. These teeth or lugs can also perform the function of centering the insulator in relation to the magnet system.

Also in accordance with the present invention, a single spring retaining clip can be replaced by two clips which are disposed one above the other in the direction of the axis of the excitation coil, the two clips being interconnected by means of a central strip. The two clips can then be fixed to the return pole piece by means of the central strip during a preliminary assembly operation.

Many other objects, features and advantages of the present invention will become manifest to those skilled in the art upon making reference to the drawings attached hereto and the following description of the preferred embodiment.

DESCRIPTION OF THE PREFERRED EMBODIMENTS

Figure 1:
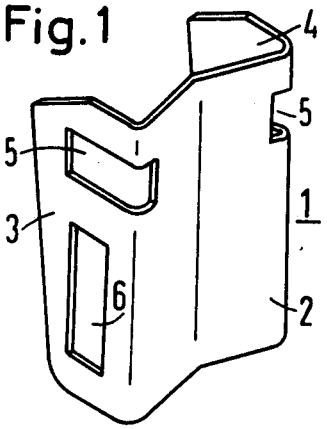
FIG. 1 is a perspective view of a spring retaining clip constructed in accordance with the principles of the present invention.

FIG. 1 discloses a spring retaining clip constructed in accordance with the principles of the present invention and indicated generally at reference numeral 1. The retaining clip 1 is generally U-shaped, and includes a back wall member 2 which is curved (or bent) inwardly so that it may be disposed in close proximity to the excitation coil of an electromagnetic relay while permitting a lengthy spring travel in a space-saving arrangement.

The retaining clip 1 also comprises a pair of side wall members indicated at 3 and 4, each of which is provided with a window-shaped recess 5 for preliminary assembly on a return pole piece of an electromagnetic relay, and a window-shaped recess 6 for engagement with a contact spring carrying insulator.

Figure 2:
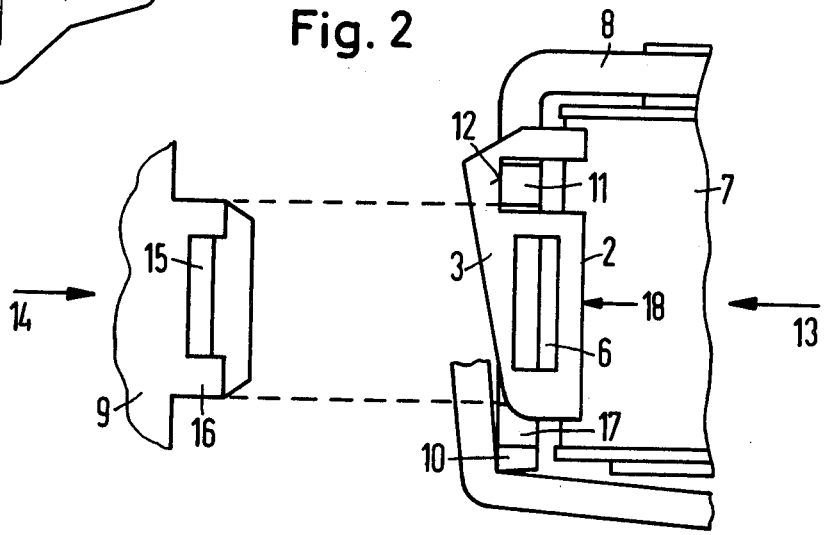
FIG. 2 is a side elevational view of the spring retaining clip of FIG. 1 mounted on the return pole piece of an electromagnetic relay, with a cooperating contact-carrying insulator in position for assembly therewith.

FIG. 2 discloses a magnet system including an axial excitation coil 7 and an angular return pole piece 8 which is to be connected to an insulator 9, the insulator being a carrier for a contact spring set (not shown). To this end, the retaining clip 1 is disposed with its back wall member 2 situated between the coil 7 and a central portion 10 of the return pole piece 8. The curvature or bend of the back wall member 2 of the retaining clip 1 preferably corresponds to the curvature of the outer surface of the coil winding of the excitation coil 7.

The side wall members 3 and 4 of the retaining clip 1 extend over or straddle the central portion 10 of the return pole piece 8. During preliminary assembly, the side wall members 3 and 4 are locked to corresponding projections or lugs 11 formed on the central return pole piece portion 10, the window-shaped recesses 5 receiving the lugs 11 in cooperating locking relation.

After the retaining clip 1 is mounted on the central portion 10 of the return pole piece 8, the back wall member 2 of the retaining clip 1 is in abutting engagement with the central portion 10, thereby forcing a forward wall 12 of each of the recesses 5 into engagement with a corresponding forward wall of each of the lugs 11.

During final assembly of the retaining clip 1 and the insulator 9, these two components are moved toward one another in the directions indicated by the arrows shown at reference numerals 13 and 14. The insulator 9 comprises a pair of rectangularly shaped projections 15 which extend respectively in a transverse direction from a pair of insulator side walls 16. As the insulator 9 is moved in the direction of the retaining clip 1, the insulator side walls 16 are inserted into the retaining clip 1 adjacent the retaining clip side walls 3 and 4 and between the side walls 3 and 4 and the central portion 10 of the return pole piece 8. In order to enable the insulator 9 to be easily and conveniently centered with respect to the retaining clip 1 and the return pole piece 8, the central portion 10 has formed thereon another pair of lugs or protrusions 17 which, along with lugs 11, guide the insulator 9 into a centered position.

After the insulator 9 has been moved into engagement with the retaining clip 1, the outer edges of the back wall member 2 of the retaining clip 1 are forced in the direction of the insulator 9, thereby slightly straightening the back wall member 2 as it abuts the central portion 10 of the return pole piece 8, and enabling the rectangular lugs 15 formed on the side walls 16 of the insulator 9 to be received in the window-shaped recesses 6 formed in the side walls 3 and 4 of the retaining clip 1.

Figure 3:
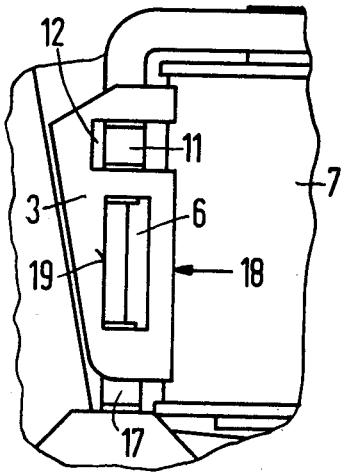
FIG. 3 is similar to FIG. 2, but discloses the insulator in assembled relation with respect to the spring retaining clip.

As shown in FIG. 3, after the insulator 9 has been mounted in the retaining clip 1, and the lugs 15 have been received in the recesses 6, the front edge 12 of each of the recesses 5 no longer abuts its corresponding lug II, but instead a front edge 19 of each of the recesses 6 abuts a forward wall of its corresponding rectangular lug 15 of the insulator 9. Thus, after final assembly of the retaining clip 1 and the insulator 9, the back wall member 2 of the retaining clip 1 has been straightened from the curved or bent free state configuration thereof shown in FIG. 1, and the lugs 15 of the insulator 9 are securely locked in the recesses 6 of the retaining clip 1.

Figure 4:
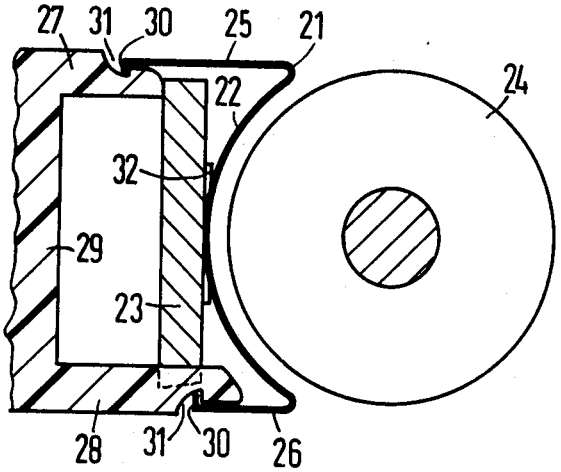
FIG. 4 is a top sectional view of another embodiment of the present invention.

FIG. 4 discloses another embodiment of the present invention in which a curved back wall member 22 of a retaining clip 21 is disposed between the central portion of a return pole piece 23 and the correspondingly outer curved surface of the windings of an excitation coil 24. In the embodiment side walls 25 and 26 of the retaining clip 21 straddle the return pole piece 23 and are connected in locking relation with a pair of side wall members 27 and 28 of a contact carrying insulator 29. A pair of in-turned flanges or ears 30 are formed at the ends of the retaining clip side walls 25 and 26 and are received in a pair of notches or recesses 31 formed in the side walls 27 and 28 of the insulator 29.

FIG. 4 illustrates a difference between the configuration of insulator side wall 27 and side wall 28 for the purpose of demonstrating different design possibilities. Thus, side wall 27 can be formed identically to side wall 28 and vice versa. As illustrated, side wall 27 engages and bears upon the return pole piece 23, whereas side wall 28 extends past the return pole piece 23. In either arrangement, however, the locking relation between the retaining clip 21 and the insulator 29 occurs in rather close proximity to the return pole piece 23, thereby ensuring relatively lengthy creep paths.

The retaining clip 21 may actually consist of two or more identical clips located one above the other or in axial spaced relation with respect to the axis of the coil 24. The two clips 21 can then be interconnected by means of a central strip indicated at reference numeral 32 and thereafter secured by rivets or the like fasteners to the central return pole piece portion 23.

Although various minor modifications may be suggested by those versed in the art, it should be understood that we wish to employ within the scope of the patent warranted hereon all such modifications as reasonably and properly come within the scope of our contribution to the art.

We claim as our invention:

1. For use in an electromagnetic relay having an elongated excitation coil and a return pole piece, with the excitation coil having a curved outer surface and the return pole piece having a central portion extending in parallel and spaced relation to the outer surface of the excitation coil, the combination comprising an insulator for carrying contact springs, and a spring retaining clip for mounting the insulator on the return pole piece, said retaining clip being generally U-shaped and having a resilient back wall member disposed between said central return pole piece portion and the excitation coil and being curved in a free state condition at least somewhat similarly to the curvature of the outer surface of the excitation coil, and having a pair of spaced side wall members extending from said back wall member and away from the excitation coil and straddling the central return pole piece portion, said insulator having a pair of side wall members movable into assembled position between the side wall members of said retaining clip, and cooperating interlocking means formed on said side wall members of said retaining clip and said insulator and engageable with one another in locking relation when said back wall member of said retaining clip is in abutting relation with said central return pole piece portion and forced from its curved, free state condition to a lesscurved assembled state condition.

2. The invention as defined in claim 1 wherein said cooperating interlocking means comprises lug and window means formed on said side wall members.

3. The invention as defined in claim 1 wherein said cooperating interlocking means comprising means forming recesses in said side wall members of said insulator and means forming inwardly turned flanges on said side wall members of said spring retaining clip for insertion into said recesses.

4. The invention as defined in claim 1 wherein said side wall members of said insulator are disposed respectively between said central return pole piece portion and corresponding ones of said side wall members of said spring retaining clip when said insulator is mounted on said return pole piece.

5. The invention as defined in claim 1 wherein said side wall members of said insulator function to center the contacts wtih respect to the return pole piece.

6. The invention as defined in claim 1 and including recess means formed on said side wall members of said spring retaining clip for receiving corresponding lugs formed on said central return pole piece portion to support said spring retaining clip on said central return pole piece portion.

7. The invention as defined in claim 6 wherein said side wall members of said insulator are constructed and arranged to be insertable between said lugs on said central return pole piece portion and additional lugs disposed in spaced relation to the previously mentioned lugs for centering said insulator with repect to said spring retaining clip.

8. The invention as defined in claim 1 and including means for connecting said resilient back wall member of said spring retaining clip to the central portion of said return pole piece in fixed assembly.

9. The invention as defined in claim 1 and including a second spring retaining clip having a resilient back wall member and means for connecting the resilient back wall member of said second spring retaining clip to the resilient back wall member of the first mentioned spring retaining clip in fixed assembly.

* * * * *